United States Patent [19]

Gray et al.

[11] Patent Number: 4,807,678

[45] Date of Patent: Feb. 28, 1989

[54] APPARATUS FOR NOTCHING PALLET STRINGERS

[75] Inventors: Billy H. Gray; Keith D. Gray; Robert G. Hanna, all of West Plains, Mo.

[73] Assignee: West Plains Machinery Corporation, West Plains, Mo.

[21] Appl. No.: 139,727

[22] Filed: Dec. 30, 1987

[51] Int. Cl.[4] ..... B27C 5/00; B27M 1/00

[52] U.S. Cl. ..... 144/371; 144/2 R; 144/242 R; 144/133 A; 144/245 R; 144/368

[58] Field of Search ..... 144/2 R, 133 R, 133 A, 144/136 R, 242 R, 242 D, 245 R, 245 A, 245 E, 371, 374

[56] References Cited

U.S. PATENT DOCUMENTS

| | | | |
|---|---|---|---|
| 2,907,359 | 10/1959 | Lade | 144/136 R |
| 3,664,394 | 5/1972 | Wells | 144/133 R |
| 3,735,787 | 5/1973 | Siel | 144/133 R |
| 3,838,723 | 10/1974 | Sanberg | 144/133 R |
| 3,994,326 | 11/1976 | Sarten | 144/2 R |
| 4,132,253 | 1/1979 | Mills | 144/133 R |
| 4,489,874 | 12/1984 | Worst et al. | 144/136 B |

*Primary Examiner*—W. Donald Bray

*Attorney, Agent, or Firm*—Gravely, Lieder & Woodruff

[57] ABSTRACT

The apparatus for notching pallet stringers comprises a skid surface over which the stringers are caused move, the stringers are held down against the skid surface so that rotary cutting knives can form the notches. The apparatus is provided with a conveyor mechanism for orienting the stringer members in proper positions to encounter the rotary cutting knives regardless of the position when first placed in a crib for the conveyor. The apparatus includes a pusher device to feed stringers into the rotary knives so that the stringers are bunched up for the purpose of using stringers to support each other as they are pushed over the skid surface into the rotary knives.

10 Claims, 4 Drawing Sheets

APPARATUS FOR NOTCHING PALLET STRINGERS

BACKGROUND OF THE INVENTION

1. Field of the Invention

This invention is concerned with apparatus for rapidly and continuously cutting notches in stringer numbers used in the construction of material supporting pallets.

2. Description of the Prior Art

It is known that material capable of being palletized is conveniently picked up and moved about by fork-lift trucks. To do this the pallets must be provided with a way to allow the forks of a fork-lift truck to get under the loaded pallet so it can be lifted. Loaded pallets have considerable load carrying ability, so that manual movement is not possible because of the weight factor.

A typical pallet is constructed with a deck formed of spaced-apart boards that are interconnected by spaced stringers, and the stringers are stabilized by bottom boards. The forks of a fork lift truck are spaced apart so they can be inserted into a pallet for purposes of lifting the pallet. The pallets need to be constructed so the lift truck forks can get under the loaded deck and gain a secure engagement before lifting the pallet. It is known that pallet stringers need to be formed with notches of a size to accommodate the forks of the lift truck. The notches need to be properly sized and spaced so that they will be rendered generally universal in accommodating different fork lift trucks. The forming of notches is usually carried out by cutting across the grain of the stringer wood, and there must be an adequate surface in the notches to keep the pallet substantially level and flat on the forks so the load is securely stable when being moved about.

The problems encountered in machine notching stringer members is that tools to form the notches tend to split the wood because the tools must cut across the wood grain. Wood that splits must be discarded which adds to the cost of usable members. Notching tools are slow and expensive which adds to the cost of producing usable notched stringers.

BRIEF SUMMARY OF THE INVENTION

In accordance with the principle of the present inventions, the notching apparatus comprises a skid surface over which the stringers are caused move, means for holding the stringers down against the skid surface so that rotary cutting knives can form the notches. The apparatus is provided with endless conveyor means for orienting the stringer members in proper positions to encounter the rotary cutting knives regardless of the position when first placed in the crib for the conveyor. The apparatus includes means to feed several stringers into the rotary knives one at a time so that the stringers are bunched up for the purpose of using trailing stringers to support each leading stringers as they are pushed over the rotary knives.

BRIEF DESCRIPTION OF THE DRAWINGS

The apparatus which enables the practice of the invention has been shown in the following drawings, wherein.

DETAILED DESCRIPTION OF THE EMBODIMENTS

Figure 1:
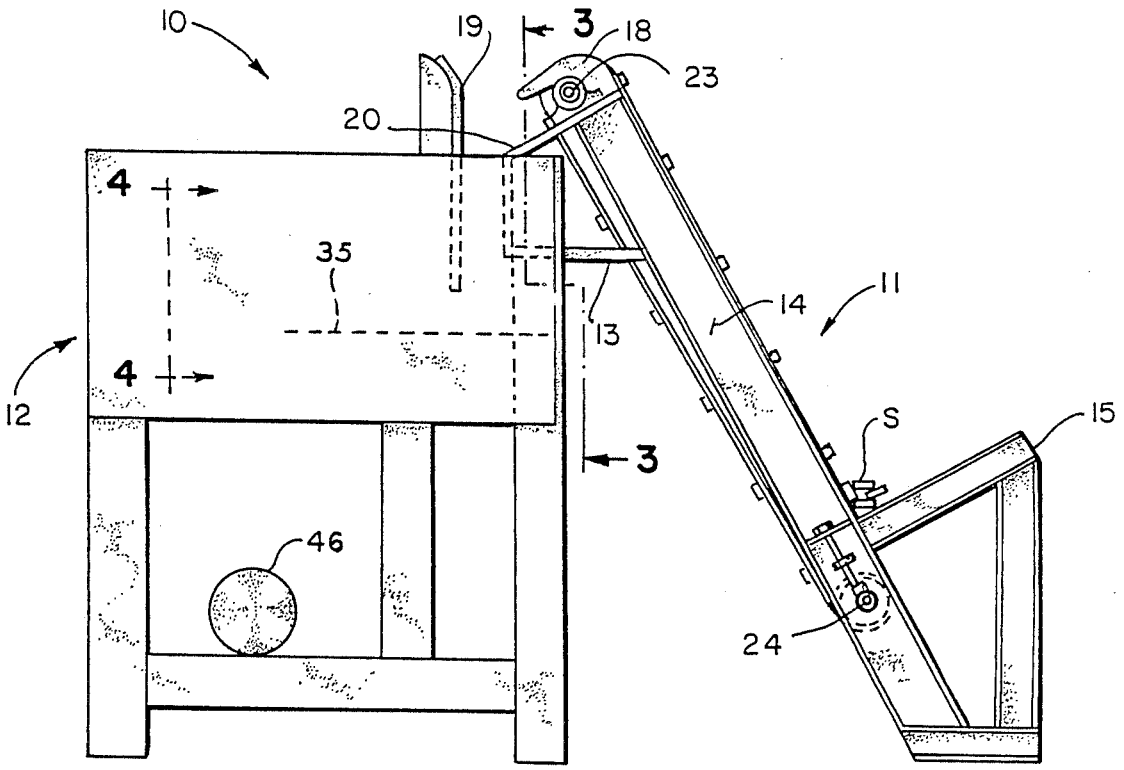
FIG. 1 is a side elevation of the apparatus showing the two principal assemblies which are the stringer unscrambling and lifting assembly and the enclosed stringer guiding and notching assembly.
Figure 2:
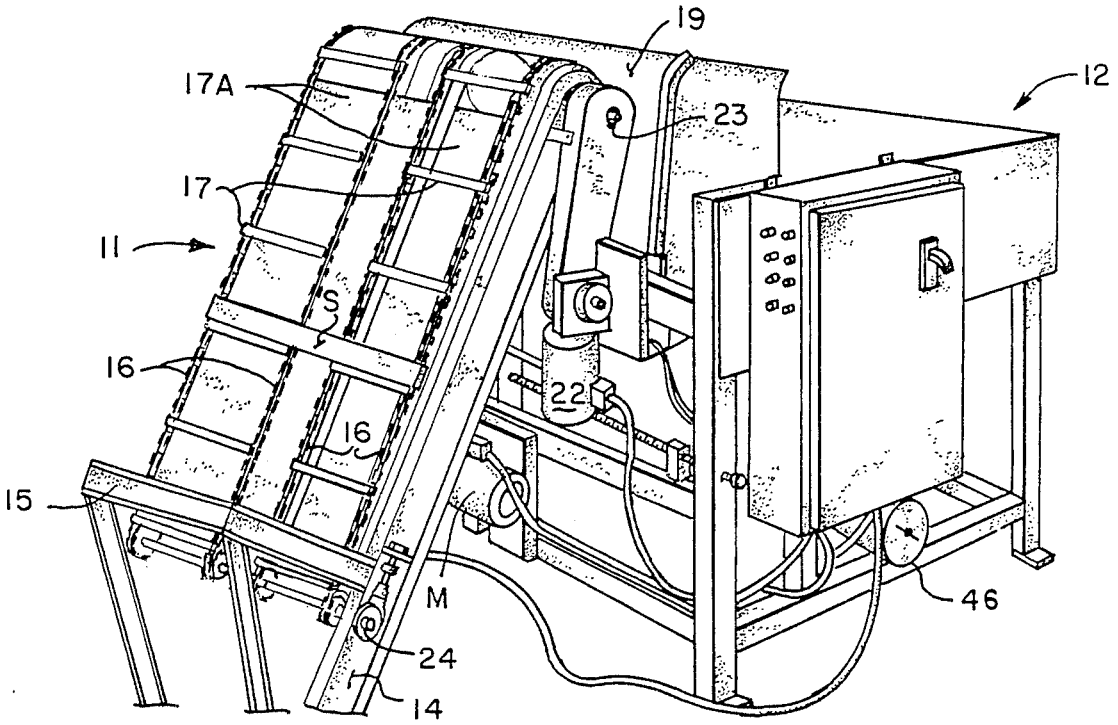
FIG. 2 is a perspective view of the principal assemblies of the apparatus of FIG. 1 as seen from the side opposite that of FIG. 1.

With reference to FIGS. 1 and 2 the present apparatus 10 comprises stringer lift assembly 11 and a notching assembly 12 interconnected by suitable means generally represented by structure 13.

With reference to FIGS. 1 and 2 the feed conveyor assembly 11 has a frame 14 with a stringer crib or apron 15 set at about ninety degrees to the frame 14. The frame carries two pairs of endless chains 16 each pair driving flat cleats 17. The chains move along the sides of flat plates 17A spaced apart to allow the chains to drive the cleats spaced at intervals to allow the 2″×4″ wood stringers S to assume positions with the wide 4″ faces lying flat against the plates 17A and the narrower 2″ thickness engaged by the cleats 17. It is noted that the cleats 17 move in aligned pairs so the stringers S rise or are carried up the frame 14 in a horizontal attitude, as shown. The arrangement of the crib or apron 15 at about ninety degrees to the inclined position of the plates 17A allows the stringers S to move onto the plates without delay. A load of stringers S can be dumped into the crotch between the flat plates 17A and apron 15 regardless of alignment or orientation. When a pair of cleats 17 move up past the apron 15, a stringer is engaged and begins its travel up the incline. If the stringer has its wide face parallel to or resting on the plates 17A, the cleats 17 will support the narrow edge which is the desired attitude. On the other hand, if a stringer S is first contacted by a pair of cleats 17 on its wide face, the stringer S will tumble or be smartly rolled backwardly because the cleats 17 are not thick enough to provide adequate support. That tumbling effect among the stringers S will continue until each stringer is eventually tumbled or rotated into a position with its narrow face presented to the cleats 17 and its wide flat face presented to the plates 17A. Thus, eventually a traveling pair of cleats 17 will pick it up and provide adequate support to carry the stringer up and cause it to move through the top guide 18 where it is able to slide on its wide face down between guide plates 19 and 20 (see FIGS. 1, 2 and 3) to an open bottom spaced above the inner end of the skids which are represented by the dotted line 35 in FIG. 1. Since the notching assembly 12 is enclosed to confine the dust and possible flying wood chips, the skids are indicated in a dotted position at 35. As the stringers passes over the top of the lift means 11, the ends will engage and be guided laterally between marginal guides 21 (FIG. 3 which is looking into the notching assembly 12 from behind the guide plates 20) so the stringers are forced to move laterally if necessary. The lift means is operated by a suitable motor means 22 connected to the top sprocket shaft 23 driving chains 16. An idler sprocket shaft 24 at the bottom of the plates 17A engages the chains 16 and can be adjusted to keep the chains properly tensioned.

Figure 4:
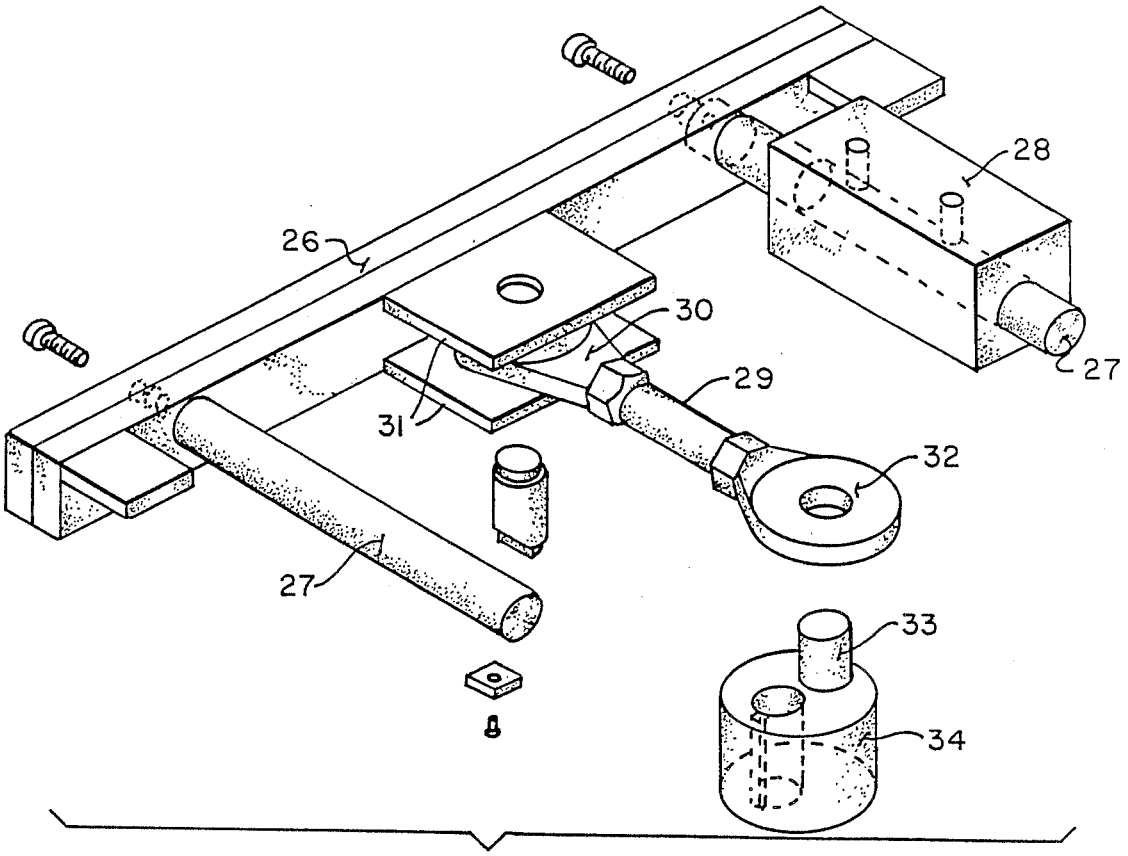
FIG. 4 is a perspective and partial exploded view of the stringer feeding mechanism for pushing the stringers into the notching assembly.
Figure 3:
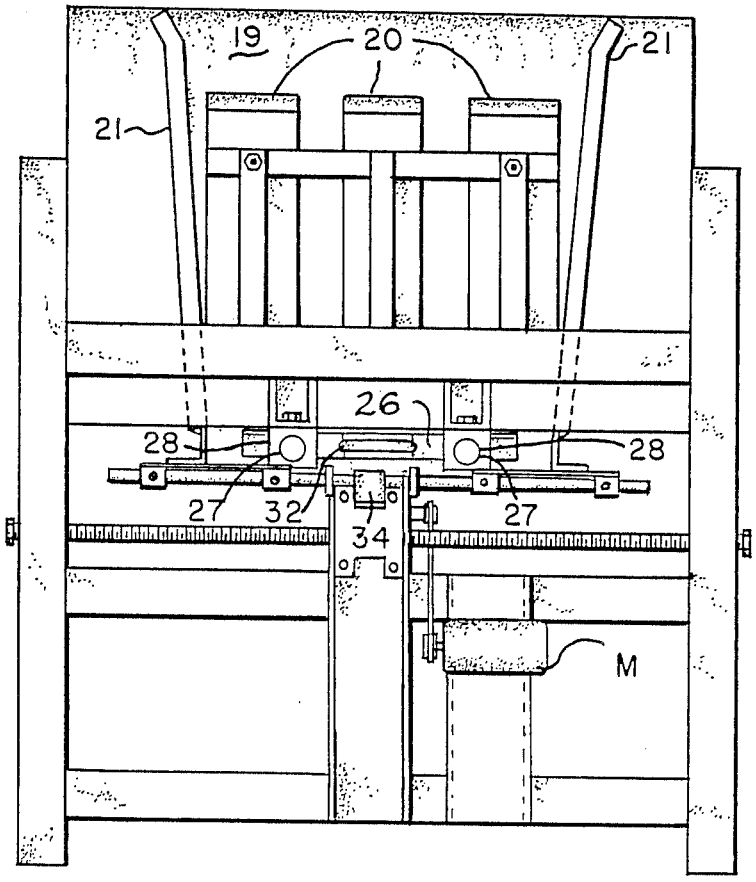
FIG. 3 is a fragmentary detailed view of the structure seen along line 3—3 in FIG. 1 to illustrate how the stringers are guided into positions to enter the notching assembly.
Figure 7:
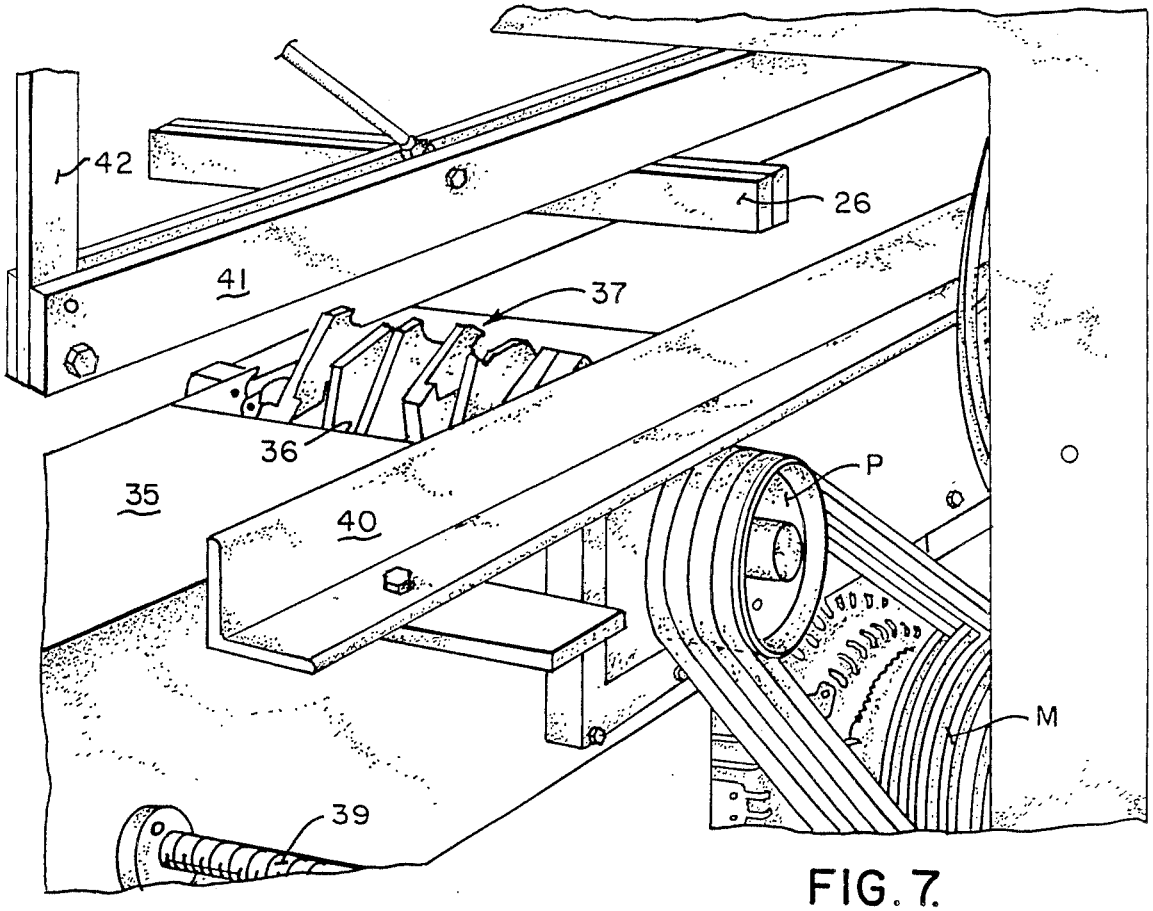
FIG. 7 is an enlarged perspective view of a typical cutter and hold-down means for one of the skids.
Figure 5:
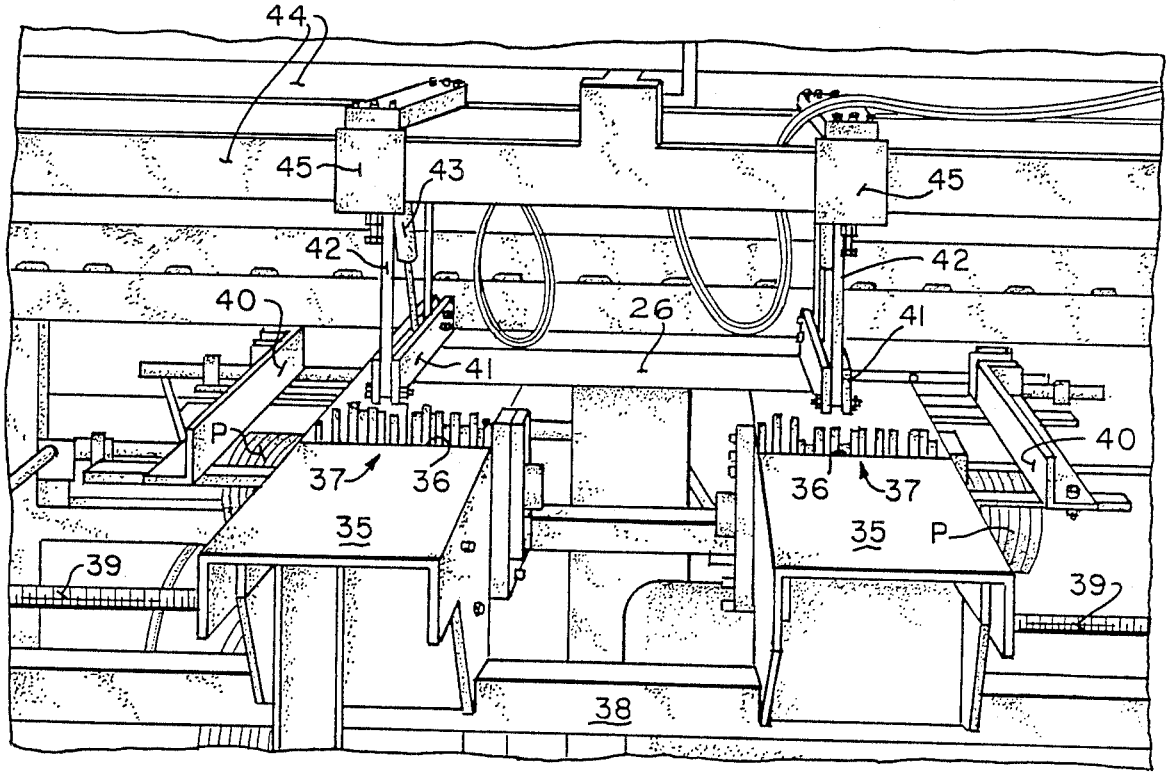
FIG. 5 is a perspective view looking into the notching assembly to show certain details thereof.
Figure 9:
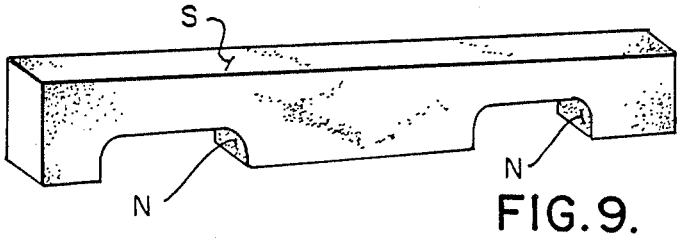
FIG. 9 is a perspective view of a typical notch stringer.

The mechanism (FIG. 4) that advances the stringers into the notching cutters comprises a ram 26 carried by a pair of rods 27 moving on suitable linear type bearing units 28. The rods 27 do not allow the ram 26 to skew and bind in the bearing units 28. A ram actuating push rod 29 has one end 30 pivotally connected to the mid-length of the pusher ram 26 between plates 31, and the other end in the form of an eye opening 32 that is received on an eccentric pin 33 carried on a rotary support 34. The support 34 is rotated by motor means M and chain drive means to oscillate the push rod 29 and cause the ram 26 to reciprocate. The amount of ram movement, or its stroke, is fixed to exceed the 2" thickness of a stringer. It is important to the successful function of the notching mechanism that two or more stringers S should slide or drop down on to a pair of skids represented in FIG. 1 by the dotted line 35. Thus, the stringers S are caught on the inner ends of the pair of skids 35 better seen in FIG. 5. The stringers S are advanced by the ram 26 for the purpose of using the trailing stringer or stringers S to offer support in surface-to-surface engagement with the lead stringers during the actual cutting of the notches N (FIG. 9) in the lead stringer as that reduces the chance of the cutters splitting the stringer as it moves past the cutters. The view of FIG. 3 shows the back side of the reciprocating pusher 26, but the operating mechanism seen in FIG. 4 has obscured the inner ends of the skids 35. A clearer view of the skids 35 and pusher 26 is shown in FIG. 5. Since means 26 reciprocates, the stringers S are advanced one at a time or intermittently so the stringers can be added behind the leading stringers.

Turning now to FIGS. 5, 6, 7 and 8 the stringer notching assembly 12 is formed with a pair of skids 35 which receive the stringers S on the 2" edges so that they stand with the 4" width vertical. The pair of skids 35 are downwardly opening channels with the flat surfaces 35 upwardly presented to support the stringers S. Each flat face 35 is notched at 36 so the gang cutter blades 37 project through the notches 36 to the desired distance for cutting notches N in the stringers. The cutter blades are not in side-to-side alignment, but are set so the right hand blades 37 are farther out on the right hand skid 35 than the left hand blades 37. This is done so when the skids 35 are moved closer together the bearing boxes 37A will be offset and not abut each other. The skids 35 are laterally adjustably carried on transversely directed members 38 so they may be moved closer together or farther apart. The skids 35 are engaged by threaded rods 39 which are hand operated to adjust the spacing of the skids 35 so that the cutter blades 37 can be positioned for cutting notches closer to the opposite ends of the stringers N or closer together and farther from the opposite ends, all as desired for the dimensions of the stringers and the notches therein.

Figure 6:
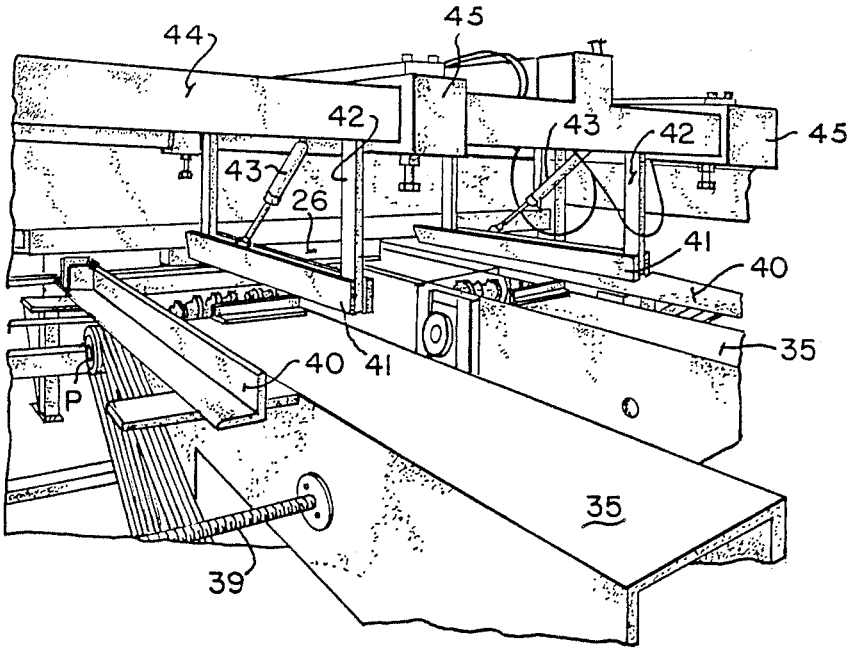
FIG. 6 is a further perspective view of the notching mechanism to disclose further details thereof.
Figure 8:
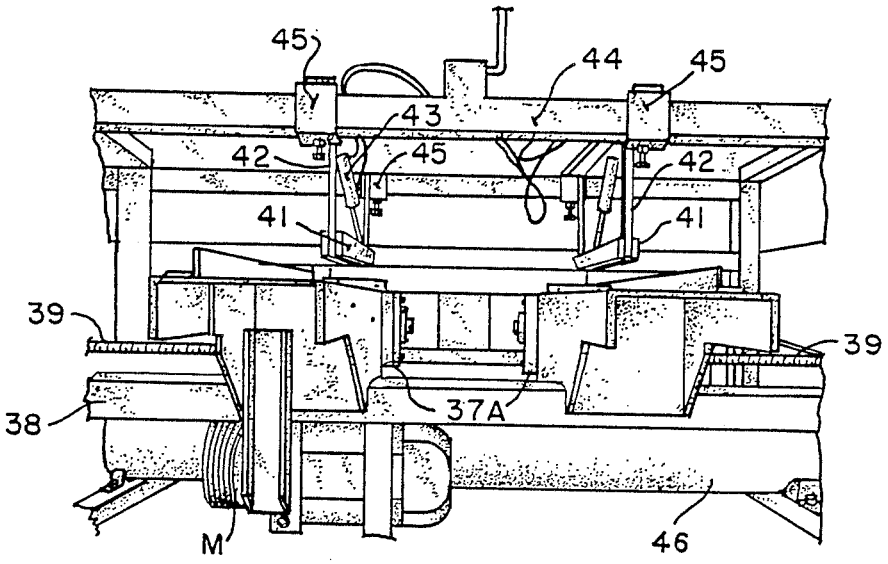
FIG. 8 is still another fragmentary perspective view of the dust collecting system for the stringer notching mechanism.

It can be seen in FIGS. 5 and 6 that the skids 35 are flanked by guides 40 which move with the skids, and that the reciprocating pusher ram 26 moves over the surface of each skid and is adapted to advance several stringers S toward the cutter blades 37. The stringers are held down on the surfaces of the skids 35 by hold down members 41. Each hold down member is mounted for swinging movement from cross members 44, and each one is actuated by a pneumatic cylinder 43 which pushes down on the member 41. The cutter blades 37 are rotated in a direction so as to bite into the stringers opposite to the advancing movement which tends to pull the stringers down on the surfaces of the skids 35. During spacing adjustment of the cutter blades and skids 35, the cutter drive motors M and belt connected pulleys P also move so as to simplify the assembly. In addition, the hold down cylinder means 43 are carried on a pair of overhead supports 44 so the hold down brackets 42 and members 41 can be moved, as desired, by sliding the ends 45 along the supports 44.

Referring to FIGS. 1 and 2 there can be seen a dust collecting conduit 46 which is directed transversely of the skids 35 to extend across the width of the notching assembly 12 for the purpose of presenting upwardly opening slots (not shown) located beneath the cutter elements 37 for the purpose of collecting the wood chips and dust during the forming of the notches N in the stringers S. A blower may be connected to the dust collector 46, although the blower has not been shown.

It can now be appreciated that the present apparatus has the unique ability to receive a plurality of stringer members S laid lengthwise in the crib so the cleats 17 can unscramble the individual members S and place them in proper orientation to be delivered to the notching assembly 12 standing upright on the 2" edges. Another unique feature of the apparatus resides in the adjustability of the cutters and associated components to cut the notches at desired locations in the stringers to match the spacing of the forks on the fork-lift trucks. There is also the unique method of operating the apparatus 10 so that each leading stringer member is advanced or pushed past the notch cutter means by a trailing stringer member next in abutment, and adding other stringer members so that the pushing of the leading stringer members can continue as long as stringer members are made available to the apparatus. Other features may come to mind without departing from the scope of the invention as defined herein.

What is claimed is:

1. Apparatus for forming notches in stringer members that have width and thickness dimensions in which the width dimension is greater than the thickness dimension, the stringers to be incorporated in portable pallets so the notches can accommodate the forks of fork lift trucks, the apparatus comprising:

(a) stringer lifting means having means for engaging and orienting the stringers in predetermined positions;

(b) crib means cooperating with said lifting means in position to receive stringers in haphazard positions, said strings responding to said lift means to rearrange the orientation into the predetermined positions;

(c) notching mechanism associated with said stringer lifting means in position to receive the stringers and retain them standing on the thickness dimension, said notching mechanism having stringer guide means and notch cutting means; and (d) ram means reciprocable in a path between a withdrawn position relative to said notching mechanism to receive a stringer and advance the stringer toward said notch cutting means.

2. The apparatus set forth in claim 1 wherein said stringer lifting means includes cleat means, and drive means engaging said cleats in aligned pairs with said aligned pairs of cleats being spaced from each other lengthwise of said lift means by a distance greater than the width dimension of the stringers.

3. The apparatus set forth in claim 1 wherein stringer guide means is disposed between said stringer lifting means and said notching mechanism for presenting the stringer in said predetermined positions oriented to stand on said thickness dimension surfaces.

4. The apparatus set forth in claim 1 wherein said stringer guide means and notch cutting means are movable to adjust the spacing between notches cut into each stringer.

5. The apparatus set forth in claim 1 wherein said ram means comprises a pusher bar having a pusher rod pivotally connected thereto, and an eccentric mechanism connected to said pusher rod for effecting reciprocating motion to said pusher bar, and means operably responsive to pusher bar motion for holding said pusher bar to a linear path of reciprocating motion.

6. A method for forming notches in each of a plurality of stringer members to be incorporated in pallets, the method comprising:

(a) providing skid way means to define a predetermined path for movement of stringer members therealong;

(a) mounting rotating notch cutting means in the skid-way means to project into the path of movement of stringer member along the skid-way means;

(c) aligning a plurality of stringer members on the skid-way means so that a leading stringer member is in position to be pushed by the next trailing stringer member through the notch cutting means and the next trailing stringer member than becomes the leading stringer member;

(d) advancing each leading stringer member by pushing on a trailing stringer through a distance to support the leading stringer complete the cutting of the notches in the leading stringer; and (e) adding trailing stringer one at a time to the plurality of stringer members already aligned on the skid-way means for continuing the support of and cutting of notches in each leading stringer member.

7. The method as set forth in claim 6 wherein the notch cutting means in the skid-way means are staggered by forming notches in the individual stringer members one at a time.

8. The method as set forth in claim 6 wherein rotating the notch cutting means in a direction to cut the notches in a direction opposing the advancing leading stringer, and using the trailing stringers to support the leading stringer against the notch cutting means.

9. The method as set forth in claim 6 wherein operatively mounting the skid way means for movement laterally of the length thereof to wary the spacing of the notches cut into the leading stringers.

10. The method as set forth in claim 6 wherein providing stringer hold down means for the stringer members.

* * * * *